US005108007A

United States Patent [19]

Smith et al.

[11] Patent Number: 5,108,007

[45] Date of Patent: Apr. 28, 1992

[54] VALVE CONTROLLED SQUEEZABLE FLUID DISPENSER

[75] Inventors: Daniel F. Smith; Gregory R. Holland, both of Irvine, Calif.

[73] Assignee: Allergan, Inc., Irvine, Calif.

[21] Appl. No.: 691,144

[22] Filed: Apr. 25, 1991

Related U.S. Application Data

[63] Continuation-in-part of Ser. No. 491,304, Mar. 9, 1990, Pat. No. 5,033,647.

[51] Int. Cl.[5] ..... B65D 35/22

[52] U.S. Cl. ..... 222/95; 222/209; 222/212; 222/494

[58] Field of Search ..... 222/92, 94, 96, 105, 222/107, 153, 130, 206, 209, 212, 213, 215, 490, 491, 494, 386.5, 95

[56] References Cited

U.S. PATENT DOCUMENTS

| | | | |
|---|---|---|---|
| 1,925,926 | 9/1933 | Kunkel | 222/494 |
| 2,208,201 | 7/1940 | Smith | 222/494 X |
| 4,102,476 | 7/1978 | Loeffler | 222/209 |
| 4,349,134 | 9/1982 | Schuster et al. | 222/494 X |
| 4,432,496 | 2/1984 | Ito | 222/212 X |
| 4,561,570 | 12/1985 | Zulauf et al. | 222/213 X |
| 4,699,300 | 10/1987 | Blake | 222/212 X |
| 4,739,906 | 4/1988 | LoTurco | 222/212 X |
| 4,760,937 | 8/1988 | Evezich | 222/212 X |

*Primary Examiner*—Michael S. Huppert
*Assistant Examiner*—Kenneth DeRosa
*Attorney, Agent, or Firm*—Poms, Smith, Lande, Rose

[57] ABSTRACT

A squeezable dispenser having a main flexible outer container closed off by a top having an opening therein and an inner collapsible flexible fluid containing bladder. A one-way flow valve is mounted in the top normally closing off the opening in the top to prevent the contents of the bladder from contamination from external sources. A vent in the top provides fluid communication between the interior of the container and the exterior thereof. A sealing member overlies the valve and normally closes off the same. The dispenser can be squeezed to dispense liquid in the bladder out through the valve.

11 Claims, 2 Drawing Sheets

VALVE CONTROLLED SQUEEZABLE FLUID DISPENSER

RELATIONSHIP TO PENDING APPLICATION

This application is a continuation-in-part of application Ser. No. 07/491,304, filed Mar. 9, 1990, now U.S. Pat. No. 5,033,647.

BACKGROUND OF THE INVENTION

The invention relates to devices for storing liquids and dispensing the same without contamination.

DESCRIPTION OF THE PRIOR ARTS

Certain liquids require preservatives to keep them fresh until such liquids are dispensed. Normally, preservatives must be packaged in the containers containing such liquids. In U.S. Pat. No. 4,409,250 to Evezich, a squeezable dispensing apparatus is disclosed. However, in Evezich, the customer is required to make an aseptic connection, then screw the parts together. It is intended to be reusable with a replaceable liner or bladder. This is undesirable in operations where it is necessary to prevent microbial contamination. In U.S. Pat. No. 4,349,134 to Schuster et al., a valved container for dispensing flammable liquids is disclosed. Obviously, Schuster et al. is not concerned with the problem of microbial contamination. There is no liner or bladder nor is there a sealing member between the projection 26 and cap 8. In U.S. Pat. No. 3,160,329 to Radic et al., a dispensing device is described having a valve member 12 which is drawn over a support member 10 having a nipple 20. Radic et al. is also not concerned with microbial contamination since his device is used to dispense toothpaste, cosmetic creams, paints, etc. There is no separate liner or bladder nor is there a separate sealing member with a very small orifice between the nipple 20.

Thus, there exists a need for a squeezable dispenser which can be filled aseptically with a liquid, then used to dispense such liquid in an aseptic manner.

SUMMARY OF THE INVENTION

It is an object of this invention to provide a squeezable dispenser apparatus which can be filled aseptically with a liquid, then used to dispense the liquid in an aseptic manner.

It is a further object of this invention to provide a squeezable dispenser apparatus having a one-way check valve to prevent the liquid contents from being contaminated by external sources.

These and other objects are preferably accomplished by providing a squeezable dispenser having a main flexible outer container and an inner collapsible flexible fluid containing bladder. A one-way flow valve is provided between the outer container and the inner bladder to prevent the contents of the bladder from contamination from external sources.

DESCRIPTION OF THE PREFERRED EMBODIMENT

Figure 1:
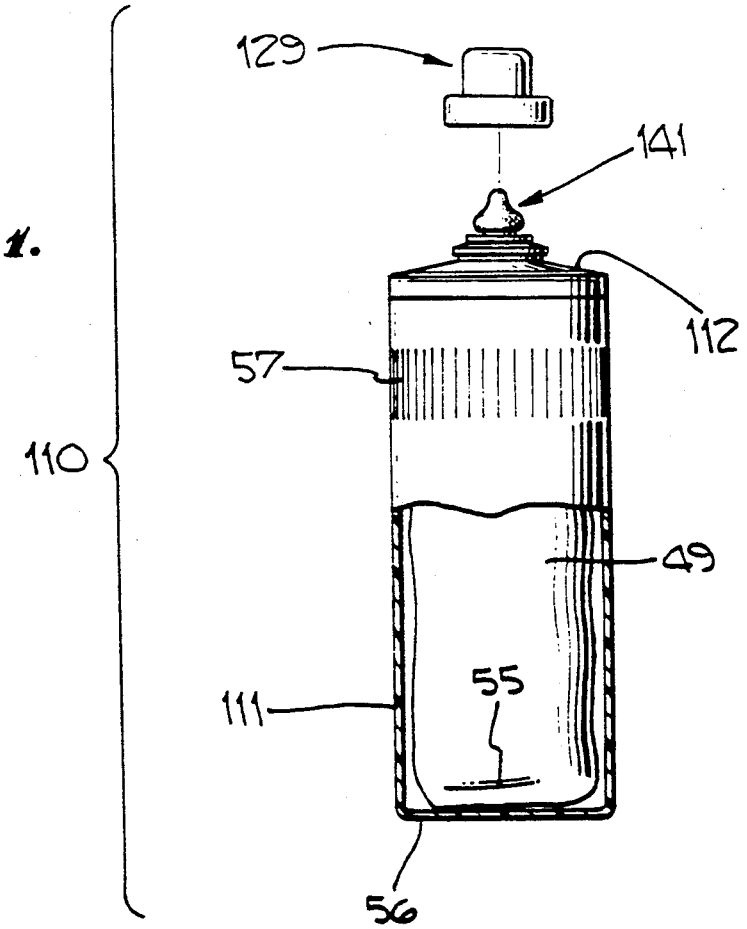
FIG. 1 is a vertical cross-sectional view of a squeezable dispenser apparatus in accordance with the invention.

Referring now to FIG. 1 of the drawing, apparatus 110 is shown comprising a container 111 closed off at the top by a top 112 (FIG. 2) and at bottom by bottom wall 56 (FIG. 1). Container 111 has a neck portion 116.

A cap 129 snap fits to top 112.

Figure 2:
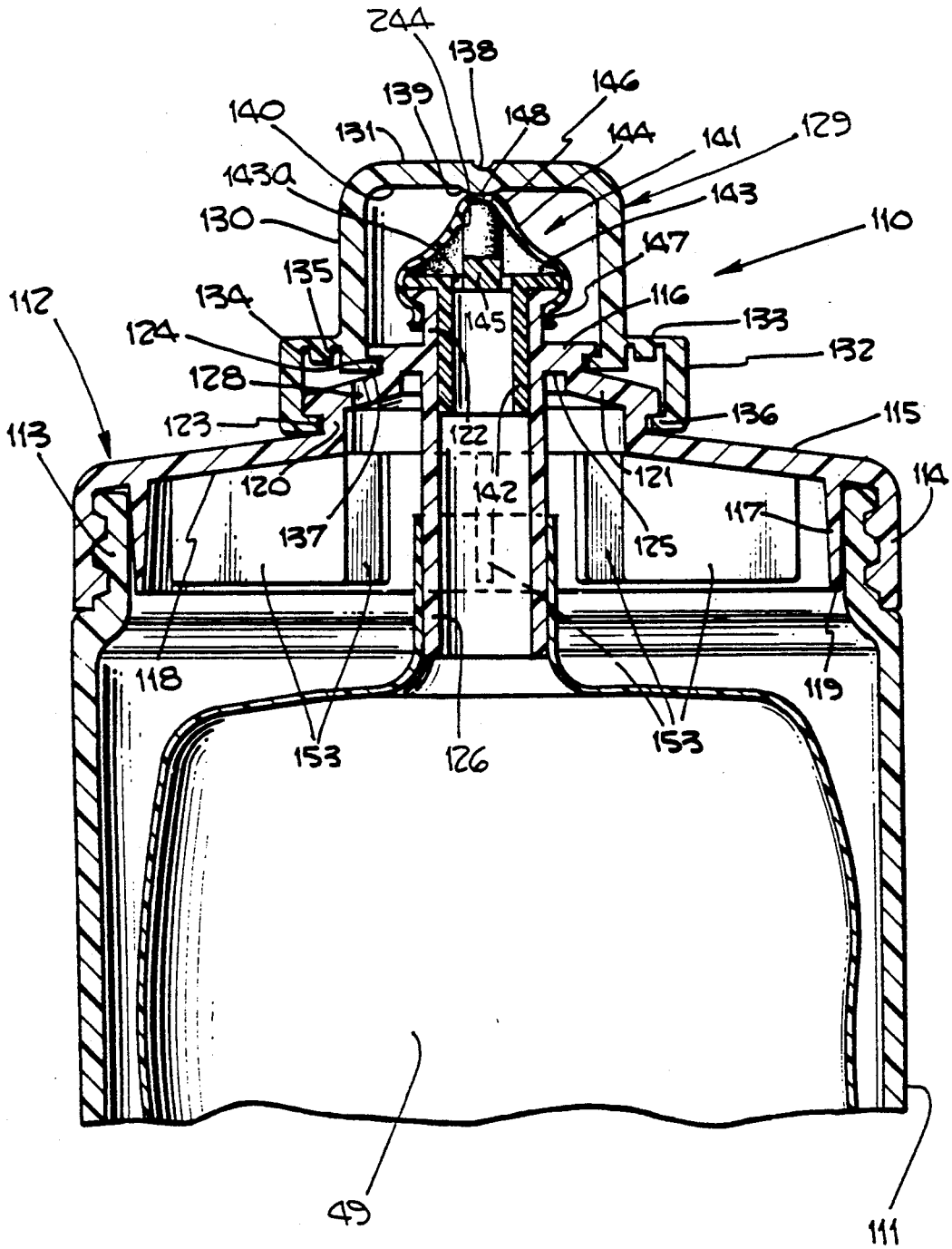
FIG. 2 is a vertical view, partly in section, of a portion of the apparatus of FIG. 1.

As seen in FIGS. 1 and 2, and as particularly contemplated in the invention, a collapsible liner 49 is provided on the interior of container 111.

Any suitable materials may be used. Container 111 is preferably of a flexible material, such as polyethylene, which can be squeezed or compressed. Liner 49 is also of a suitable flexible and collapsible material, such as polyethylene, or a lamination of metallized oriented polypropylene and ethylenepropylene copolymer. The latter is particularly suited for solutions requiring high gas or moisture barrier.

Container 111 can be injection molded. Liner 49 is provided with an opening 55 in the bottom thereof which, as seen in FIG. 1, is normally open then used to fill liner 49 with a liquid and subsequently heat sealed closed.

Liner 49 is filled with a suitable liquid through opening 55, which is then heat sealed to seal the same. Container 111 can now be secured to top 112 with cap 129 snapped into place, concave portion 139 (FIG. 2) sealing off opening 148 as will be discussed further hereinbelow. When it is desired to dispense liquid from liner 49, cap 129 is peeled away with portion 132 in FIG. 2 acting as a peel-away ring as discussed in conjunction with the embodiment of FIGS. 1 to 3 in pending application Ser. No. 07/491,304, the teachings of which are incorporated herein by reference.

The size and shape of container 111 may, of course, be varied. Liner 49 can be attached to portion 120 in any suitable manner. If desired, grasping means, such as textured areas or ribs 57 (FIG. 1) may be provided about the exterior of container 11 to facilitate grasping.

Referring now to FIG. 2 of the drawing, apparatus 110 is shown comprising a liquid container 111 closed off at the top by a screw-threaded top 112. Container 111 thus has a threaded neck portion 113 adapted to threadably engage a peripheral threaded skirt portion 114 on top 112 in a fluid tight manner. Skirt portion 114 is integral with a top wall portion 115 terminating in a generally centrally located neck portion 116. Top wall portion 115 has a generally flexible annular ring 117 extending downwardly from, and preferably integral with, inner wall 118 of top wall portion 115. Ring 117 is preferably wider at the base where it meets inner wall 118 and tapers downwardly to generally a point 119. Ring 117 acts to seal top 112 to neck portion 113.

Neck portion 116 comprises a generally centrally located first cylindrical portion 120 having an arcuate top wall portion 121 integral with a second cylindrical portion 122. A first annular groove 123 is provided on the exterior of first cylindrical portion 120, where it meets top wall portion 115, and a second annular groove 124 is provided in top wall portion 121. It can be seen that top wall portion 121 is enlarged on the upper surface to provide for groove 124 and stepped on the interior thereof at step portion 125 adjacent an elongated tubular portion 126, which may be a continuation of second cylindrical portion 122 (and, preferably of the same diameter throughout). The top of second cylindrical portion 122 terminates in an enlarged flanged inlet 127 as shown.

A vent 128 is provided in top wall portion 121 communicating the interior of top 112 with the exterior thereof. As seen, vent 128 may be wider at the interior of top wall portion 121 than at the exterior thereof.

Cap 129 snap fits to top 112. Cap 129 has a first generally cylindrical skirt portion 130 with a top wall 131 and a second generally cylindrical skirt portion 132 (the aforementioned peel-away portion). These portions 130, 131 and 132 may all be of one piece, preferably of resilient material, and skirt portion 132 may be resiliently secured to skirt portion 130 by a flange 133 with living hinge portion 134 between skirt portion 132 and flange 133, on one hand, and living hinge portion 135 between skirt portion 130 and flange 133 on the other hand.

The second cylindrical portion 132 terminates at bottom in an inwardly extending peripheral flange 136 which snap fits into groove 123. The first cylindrical portion 130 terminates at bottom in an inwardly extending peripheral flange 137 which snap fits into groove 124. A depression 138 is provided in generally the center of the outside of top wall 131 aligned with an inwardly extending concave portion 139 formed on the inner wall 140 of top wall 131.

The open end of cylindrical portion 122 is closed off by a nozzle 141 having a generally cylindrical elongated portion 142, of an outer diameter generally related to the inner diameter of portion 122 and tubular portion 126 and fitting therein, and an integral generally horizontal apertured flange 143 having apertures **143*a* therethrough overlying the enlarged flange 127 of cylindrical portion 122. A bell-shaped nozzle sealing tip, 144, which may be of elastomeric material, is provided overlying a flange 143, which may be of a rigid polyethylene material. An annular bead 244 may be provided on the inner wall of sealing tip 144 adapted to engage round portion 146 of member 145 as particularly seen in FIG. 3. Flange 143 has an integral sealing member 145 mounted in the open upper end of cylindrical portion 142. As seen, tip 144 extends over the upper rounded portion 146 of sealing member 145 overlying the same, and extends downwardly therefrom and curves about and under flange 143 (terminating in an annular bead 147 snap fitting under flange 127). An opening 148 is provided at the upper end of nozzle 141 communicating the interior thereof with the exterior. Concave portion 139 bears against and normally seals off opening 148 with sealing member 145 also bearing against and sealing off the opening 148. That is, concave portion 139 and sealing member 145 cooperate to normally close off opening 148**.

A plurality of spaced radially extending planar ribs 153 are provided integral with the inner wall 118 of top wall portion 115, such as by molding, for reasons to be discussed. Collapsible liner 49 in FIG. 2 is provided on the interior of container 111, sealed to the bottom of tubular portion 126 in a fluid tight manner, such as by heat sealing. Any suitable materials may be used. Container 111 is also preferably of a flexible material, such as polyethylene, which can be squeezed or compressed. Tip 144 and flange 143 could be removed and liner 49 filled from the top, if desired. Of course, in this filling option, opening 55 in liner 49 would not be required.

Nozzle 141 is preferably of a flexible material, such as an elastomeric material, comprised of a rigid sealing flange 143 and integral sealing member 145 closing off the open upper flanged end 143. Sealing tip 144 overlies member 145 and flange 143. Cap 129 may also be of plastic material and acts as a tamper-proof overcap both protecting the nozzle 141 from physical damage and preventing accidental dispensing of fluid from liner 49 by concave portion 139 bearing down on the rounded portion 146 of member 145. Thus, portion 132 acts as a peel-away ring which can be torn off at hinges 134, 135 and peeled off to also remove cap 129. Of course, no such ring need be provided and cap 129 may merely be removable by deengagement from top 112.

Figure 3:
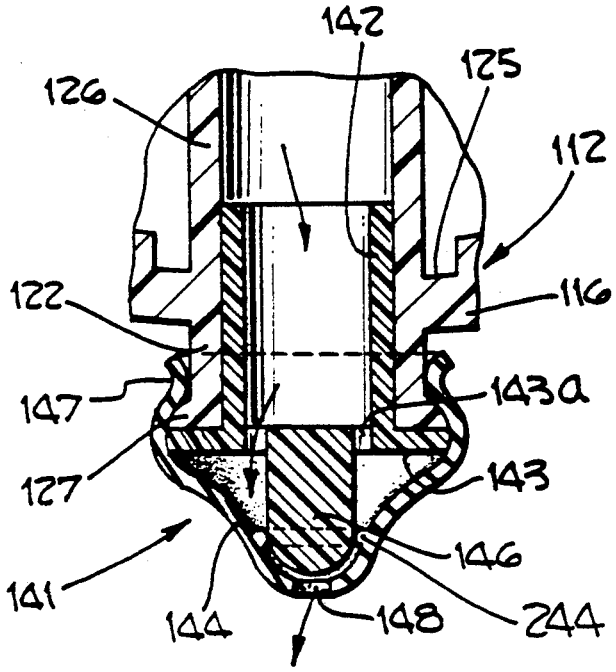
FIG. 3 is an enlarged view of a portion of the apparatus of FIG. 2, the top removed for convenience of illustrating the operation thereof.

Container 111 can be injection molded and ribs 153 keep any liquid solution in liner 49 from falling or dropping to a place where such liquid can't be dispensed. That is, when container 111 is inverted to dispense liquid, as seen in FIG. 3, the liquid filled liner 49 falls onto and about ribs 153 which thus separates the liner 49 which prevents the liquid therein from dropping to a place from which it can't be dispensed.

In operation, with liner 49 heat sealed to tubular portion 126, liner 49 is filled with a suitable liquid through opening 55 which is then heat sealed as previously discussed. Nozzle 141 is thus placed into inlet 127, as seen in FIG. 2, with elongated portion 142 extending into flanged inlet 127 (see FIG. 3). Cap 129 is snapped into place with concave portion 139 sealing off opening 148. When it is desired to dispense liquid from liner 49, cap 129 is removed as heretofore discussed. Apparatus 110 is then inverted and squeezed as seen in FIG. 3, and liquid flows from liner 49 through tubular portion 126, into portion 142 of nozzle 141, through apertures **143*a*, about sealing member 145, and out hole 148. After such inversion, apparatus 110 is then re-inverted, and air enters vent 128 returning container 111** back to its original configuration.

The combination of the ribs 153, liner 49 and valve 141 forms a barrier to microbial contamination, thus allowing liquids that normally require preservatives to be packaged without a preservative. Another advantage is that the very small volume of the opening 148 in valve 141 reduces the chance for microbial contamination.

The vent 128 can, of course, be located at any desired location on container 111 and allows air to be drawn in between container 111 and liner 49, thus allowing container 111 to return to its original shape.

Bead 244 improves the overall performance of dispenser 110.

The size and shape of container 111 may, of course, be varied. Liner 49 can be attached to tubular portion 126 in any suitable manner. If desired, grasping means, such as textured areas or ribs 57, FIG. 1, may be provided about the exterior of container 111 to facilitate grasping.

Valve 141 may, of course, be fitted to flanged end 127 in any suitable manner. In manufacturing apparatus 110, container 111 and liner 49 may be one integral piece and disposable after use. Alternatively, container 111 could be independent of the liner 49 with liner 49 attached thereto in any suitable manner and nozzle 141 snapped into place or otherwise used to close off the open flanged end 127.

In manufacturing apparatus 110, container 111 and liner 49 may be one integral piece and disposable after use. Alternatively, container 111 could be independent of the liner 49 and nozzle assembly 141.

It can be seen that there is disclosed a squeezable dispensers having a valve sealing off the dispenser outlet. A protective cap 129 holds the seal nozzle 141 tightly against the projection or sealing member 145. Squeezing of container 111 causes the nozzle 141 to move away from sealing member 145 so that liquid from liner 49 can flow out of hole 148. The liner 49 can be filled with a liquid aseptically and then such liquid can be dispensed therefrom in an aseptic manner. The combination herein results in a one-way flow or check preventing the contents of liner 49 from being contaminated by external sources.

We claim:

1. A squeezable dispenser comprising:

a main body portion having an opening at the upper end thereof;

a top secured to said main body portion closing off the opening at the upper end of said main body portion and having an opening at the upper end thereof and a vent in said top communicating the interior of said dispenser with the exterior thereof;

a resilient valve mounted in said top, said valve having a projection extending upwardly from an integral apertured flange and a downwardly extending main body portion integral with said flange;

a flexible collapsible liner associated with said valve and secured to said top;

a resilient sealing member having an aperture therethrough, said projection normally directly engaging said sealing member aperture and totally closing off said sealing member aperture when said sealing member overlies said projection and is in contact therewith, said sealing member being secured to said top, and a removable cap normally closing off the opening in said top, said cap having an inner wall and an outer wall, and a generally centrally located protrusion on the inner wall of said cap normally bearing against the aperture in said sealing member.

2. In the dispenser of claim 1 wherein said top has an outer wall and an inner wall, a flexible annular ring integral with said inner wall and extending downwardly therefrom, said top being coupled to said main body portion of said dispenser by a top interconnecting member mating with a main body portion interconnecting member, said ring being spaced from said top interconnecting member with said main body portion interconnecting member receivable between said ring and said top interconnecting member.

3. In the dispenser of claim 2 including a plurality of spaced radially extending planar ribs integral with and extending downwardly from the inner wall of said top.

4. In the dispenser of claim 1 wherein said top has an inner wall and an outer wall, and a plurality of spaced radially extending planar ribs integral with and extending downwardly from the inner wall of said top.

5. In the dispenser of claim 1 including a break-off ring on said cap engaging said top and normally securing said cap to said top.

6. In the dispenser of claim 1 wherein said sealing member is generally bell-shaped with said aperture being generally centrally located therein, said sealing member having an outwardly and downwardly curved portion integral with said valve flange.

7. In the dispenser of claim 1 wherein the opening in said top is coincident with a downwardly extending tube, the main body portion of said valve being disposed in said tube with said valve flange overlying the opening in said top.

8. In the dispenser of claim 1 wherein said sealing member is heat sealed to said top.

9. In the dispenser of claim 1 wherein said sealing member has an inner wall in contact with said projection and including an annular bead extending about the inner wall of said sealing member abutting against said projection, said annular bead being disposed adjacent said sealing member aperture and spaced therefrom.

10. A squeezable dispenser comprising:

a main body portion having an opening at the upper end thereof;

a top secured to said main body portion closing off the opening at the upper end of said main body portion and having an opening at the upper end thereof and a vent in said top communicating the interior of said dispenser with the exterior thereof;

a resilient valve mounted in said top, said valve having a projection extending upwardly from an integral apertured flange and a downwardly extending main body portion integral with said flange;

a flexible collapsible liner associated with said valve and secured to said top; and a resilient sealing member having an aperture therethrough, said projection normally engaging said sealing member aperture and closing off said sealing member aperture when said sealing member overlies said projection and is in contact therewith, said sealing member being secured to said top, said top having an outer wall and an inner wall, a flexible annular ring integral with said inner wall and extending downwardly therefrom, said top being coupled to said main body portion of said dispenser by a top interconnecting member mating with a main body portion interconnecting member, said ring being spaced from said top interconnecting member with said main body portion interconnecting member receivable between said ring and said top interconnecting member, and a plurality of spaced radially extending planar ribs integral with and extending downwardly form the inner wall of said top.

11. A squeezable dispenser comprising:

a main body portion having an opening at the upper end thereof;

a top secured to said main body portion closing off the opening at the upper end of said main body portion and having an opening at the upper end thereof and a vent in said top communicating the interior of said dispenser with the exterior thereof;

a resilient valve mounted in said top, said valve having a projection extending upwardly from an integral apertured flange and a downwardly extending main body portion integral with said flange;

a flexible collapsible liner associated with said valve and secured to said top; and a resilient sealing member having an aperture therethrough, said projection normally engaging said sealing member aperture and closing off said sealing member aperture when said sealing member overlies said projection and is in contact therewith, said sealing member being secured to said top, said top having an inner wall and an outer wall, and a plurality of spaced radially extending planar ribs integral with and extending downwardly from the inner wall of said top.

* * * * *